US005413530A

United States Patent [19]

Montaz

[11] Patent Number: 5,413,530

[45] Date of Patent: May 9, 1995

[54] DEVICE FOR CONTROLLING TEMPERATURE IN A ROOM

[75] Inventor: Edmond Montaz, Le Vesinet, France

[73] Assignee: S P I R E C -sarl-, Paris, France

[21] Appl. No.: 182,669

[22] Filed: Jan. 14, 1994

Related U.S. Application Data

[63] Continuation of Ser. No. 952,516, Dec. 3, 1992, abandoned.

[51] Int. Cl.[6] ..... F24F 7/06; F24F 13/04

[52] U.S. Cl. ..... 454/262; 454/263; 454/264

[58] Field of Search ..... 454/261, 262, 263, 264

[56] References Cited

U.S. PATENT DOCUMENTS

| | | | |
|---|---|---|---|
| 2,579,507 | 12/1951 | MacCracken | 237/2 |
| 3,058,664 | 10/1962 | Donahue | 454/262 X |
| 3,259,178 | 7/1966 | Tarnoff | 454/264 X |
| 3,390,720 | 7/1968 | Meckler | 454/264 X |
| 3,422,888 | 1/1969 | Coleman et al. | 454/262 X |
| 4,276,817 | 7/1981 | Meckler | 454/264 |
| 4,858,519 | 8/1989 | Meckler | 454/264 |

FOREIGN PATENT DOCUMENTS

| | | | |
|---|---|---|---|
| 2656071 | 6/1991 | France . | |
| 3044080 | 9/1982 | Germany . | |
| 37750 | 4/1922 | Norway | 454/263 |
| 91644 | 3/1958 | Norway | 454/263 |

*Primary Examiner*—Harold Joyce
*Attorney, Agent, or Firm*—McAulay Fisher Nissen Goldberg & Kiel

[57] ABSTRACT

A device for regulating the temperature in a room having an extraction vent and a delivery vent, using pulsed low-velocity air flow (qs). A pipe is provided in communication with a pressurized air supply duct via extraction and delivery orifices, and the extraction vent and the delivery vent open out into the pipe. Two coaxial air streams are formed in the pipe between the extraction and delivery orifices, and a central stream is produced in which the air moves at a high velocity and a peripheral annular air stream is formed surrounding the central air stream in which the air moves at low velocity.

21 Claims, 4 Drawing Sheets

DEVICE FOR CONTROLLING TEMPERATURE IN A ROOM

This is a continuation of application Ser. No. 07/952,516, filed on Dec. 3, 1992, abandoned.

BACKGROUND OF THE INVENTION

1. Field of the Invention

The present invention relates to a device for regulating temperature in a room with the aid of an air flow, at a given temperature, pulsed therein.

2. Description of the Prior Art

It is known that, in air-conditioning installations, in order to ensure a maximum of comfort for the user moving in the air-conditioned room, on the one hand, the difference in temperature between the pulsed air and the ambient temperature of the room, as well as the velocity of the air pulsed therein, must be as small as possible and, on the other hand, the functioning of the device must be particularly silent. This latter condition implies that the air in movement, in contact with the wall of the conduits, moves at low velocity.

Now, to transport, at low velocity, a mass of air of which the temperature is close to that of the room to be air-conditioned and nonetheless presenting the quantity of calories, or negative kilogram calories, necessary to maintain the desired temperature in the room, the air-conditioning installations must convey large quantities of air and consequently be provided with supply conduits of large section, which increases in a prohibitive manner both their dimensions and their cost price. For these reasons, a compromise has therefore been made between, on the one hand, the conditions of optimum comfort for the user and, on the other hand, the dimensions and cost price of the conduits, by reducing the section of the latter with respect to their ideal dimensions, and by increasing the velocity of the air blown in the rooms to be air-conditioned. This results in a certain number of drawbacks.

A first drawback comes from the noise produced by the installation. In fact, it is known that the noise produced by an air-conditioning installation depends, on the one hand, on the noise produced by the air streams in movement over the walls of the ventilation conduits, noise which is directly connected with the velocity of the fluid in contact with this wall and, on the other hand, on that produced by the blowing into the room, which depends on the velocity of the air arriving therein.

A second drawback comes from the fact that, in winter, the pulsed air which is hotter than the ambient air, is directed towards the ceiling and, in summer, the pulsed air which is colder than the ambient air, is directed towards the floor of the room. Now, such a phenomenon is all the more important as the difference between the temperature of the pulsed air and that of the room is large. This difference in temperature in the systems according to the prior art being relatively great, this therefore results, both in summer and winter, in a permanent movement of the air inside the room which, added to the inherent velocity of blowing of this air, is such as to cause, by the current of air that it forms, a hindrance for the user. In order to avoid the air pulsed by the delivery vents being directed too easily, in winter towards the ceiling, and in summer towards the floor, said vents have been provided with fins directing the air blown in a direction opposite that which it tends to take normally. Although such an arrangement is such as to reduce the heat losses suffered by the air of the room in contact with the floor and the ceiling thereof, it nonetheless contributes, by creating eddies, to further increasing the noise and the current of air inside this room. Furthermore, this arrangement necessitates a reversal of the direction of the fins, at least twice a year, namely at the moment of passage from the position of heating to that of cooling, and vice versa, which increases the maintenance necessary for good functioning thereof.

Furthermore, it should be specified that the temperature gradient existing between the floor and the ceiling of the room, which is all the greater as the difference in temperature between the blown-in air and the ambient air is great, is also such as to cause a hindrance for the user.

It is also known that, in a room, part of the pulsed air flow is evacuated towards the outside, for example by a so-called VMC aeration device and/or by air leaks existing between the room and the outside. Now, this evacuated air is not evacuated with a sufficient flowrate to ensure maintenance of the room at a pressure close to atmospheric pressure and, if the room is not to be in a state of excess pressure with respect to the atmosphere, it is necessary to provide means for extracting this air. Now, as the latter contains a large number of calories, or negative calories, which, from the standpoint of the thermal balance, are important to recover, the extraction means are generally connected to the air plant where this air is processed and from which it is then returned into the rooms to be conditioned, via delivery conduits. Now, this modus operandi presents several drawbacks.

On the one hand, it requires the use of suction means such as fans, as well as additional conduits, which increases the noise, complexity, dimensions and cost of the whole of the installation.

On the other hand, the air extracted from each of the rooms is returned, after passage through the plant, in all the other rooms which, from the hygienic or microbial standpoint, particularly when this type of installation is employed in hospitals, hotels or offices, presents considerable risks for the health of the occupants of the rooms in question.

Moreover, in the existing installations, a principal conduit connected to the plant supplies a series of delivery vents disposed in parallel along this principal pipe. Now, depending on the length of the conduit existing between the upstream and downstream end vents, the pressure drop therebetween may be considerable, and the flowrates of air blown into the corresponding rooms may be very different.

One is thus led to increase the pressure of the air in the principal conduit so that the downstream delivery vents receive a sufficient pressure, which is translated by the existence of an excess pressure at the level of the upstream delivery vents. It is therefore necessary to reduce in the latter the pressure of delivery of the air, so that the velocity of the latter leaving these vents is not too high in order to cause neither noise nor disturbances for the occupants of the rooms in question. Apart from the loss of energy corresponding to the excess pressure to be applied to the pipe, this device presents the drawback of generating vibrations and whistlings at the level of the means for reducing the pressure upstream of the delivery vent.

U.S. Pat. No. 2,579,507 also proposes to pulse into a room air coming from a burner, with the aid of a convergent nozzle presenting a delivery opening and a extraction opening communicating with the room. However, apart from the fact that the temperature of the air blown in by this device is very much above the temperatures admissible in the domain of air-conditioning, the air admission opening is located upstream of the outlet orifice of the convergent nozzle and, under these conditions, the velocity of the air leaving the latter must be high in order to create a depression adapted to effect extraction of a sufficient volume of ambient air, this high velocity being translated by a high velocity of the air blown into the room, which, as set forth hereinabove, is such as to cause a hindrance for the users as well as a loud operational noise, which prohibits use thereof for applications such as for example air-conditioning in hospitals or other premises in which a certain degree of comfort is indispensable.

SUMMARY OF THE INVENTION

The present invention has for an object to avoid the drawbacks mentioned above by proposing a particularly silently operating air-conditioning device, since it reduces the two principal noise generating factors of such an installation, namely the velocity of the air in contact with the walls of the ventilation conduits of the device, and the velocity of the air blown into the premises to be air-conditioned, this air-conditioning device making it possible, in addition, to reduce the dimensions of the conduits conveying the air flow blown in by the plant and, consequently, the dimensions and cost price of this type of installation.

The present invention thus has for its object a device intended to ensure control of temperature in a room by means of a pulsed low-velocity air flow, comprising an extraction vent and a delivery vent disposed in said room, the extraction vent and the delivery vent opening out in the same pipe in communication with a pressurized air supply duct, via extraction and delivery orifices, characterized in that it comprises means adapted to create in said pipe, between the extraction and delivery orifices, two coaxial air streams, namely a central stream in which the air moves at a high velocity and a peripheral annular stream surrounding the central air stream in which the air moves at low velocity.

The device according to the invention surprisingly makes it possible to reduce one of the principal causes of the noise usually generated by this type of installation, namely the high velocity of flow of the air flow over the inner surface of the conduit, since, on the one hand, the outer annular stream acts as a sound insulator and, on the other hand, this air stream moving at a low velocity with respect to the wall, it provokes minimum noise thereon. In this way, in a particularly interesting embodiment of the invention, the central and annular air streams are created by disposing, in a blowing conduit connected to an air-conditioning plant, an element convergent from upstream to downstream which creates, at the outlet, a central air stream at high velocity and low pressure. This central stream thus extracts air from the room to be air-conditioned, which constitutes an annular stream surrounding the central stream, and which is taken along thereby at low velocity. At the end of a certain distance of flow, depending on the operational parameters of the system, a homogenization is effected in the flow canal and a homogeneous air flow is obtained at low velocity and at temperature equal to the desired delivery temperature, which is adapted to be blown into the room.

Applicants have established that, in the domain of air-conditioning, an efficient homogenization was produced when the distance separating the outlet orifice of the convergent element of the delivery vent was at least equal to seven times the diameter of the outlet orifice of said convergent element.

The present invention makes it possible to reduce both the noise and the temperature difference existing between the air blown into the room and the ambient air of this room, since the air coming from the plant, on mixing with the air extracted from the room, decreases in temperature, without the quantity of calories or of negative calories that it brings to the room decreasing as much, since the totality of the mixed air is pulsed in the room. The present invention also makes it possible, with a noise lower than the devices of the prior art, to employ an air flow coming from the plant which, at an equal number of calories/negative calories furnished, is less than that of the devices of the prior art. In fact, since the present invention makes it possible, at an equal number of calories/negative calories supplied, to reduce the difference in temperature existing between the air blown into the room and the temperature of the latter, it makes it possible, by increasing the temperature of the air supplied by the plant, to reduce the necessary air flow and therefore the section of the supply conduit.

In a particularly advantageous variant, the device according to the invention is constituted by an assembly constituted by a tubular element which comprises, successively from upstream to downstream, means for regularizing the air streams coming from the plant, an element convergent from upstream to downstream, a first lateral orifice or air extraction vent, of which the part located most upstream is located in the vicinity of the outlet orifice of the convergent element, and a second lateral orifice, or delivery vent, located at a distance from said outlet orifice equal to at least seven times the diameter thereof, and means for obturating the end of the tubular element opposite the convergent element. This embodiment makes it possible to supply to the user an assembly ready to be positioned on an installation, guaranteeing an optimum efficiency, both from the standpoint of the noise level and from that of the thermal yield, since all the elements have been calculated, checked and arranged by the manufacturer.

In another variant embodiment of the invention, the means for controlling the air streams are associated with a thermal control unit making it possible to adjust the temperature of the air flow blown in the convergent element.

BRIEF DESCRIPTION OF THE DRAWINGS

Various forms of embodiment of the present invention will be described hereinafter by way of non-limiting examples, with reference to the accompanying drawing, in which.

DESCRIPTION OF THE PREFERRED EMBODIMENTS

Figure 1:
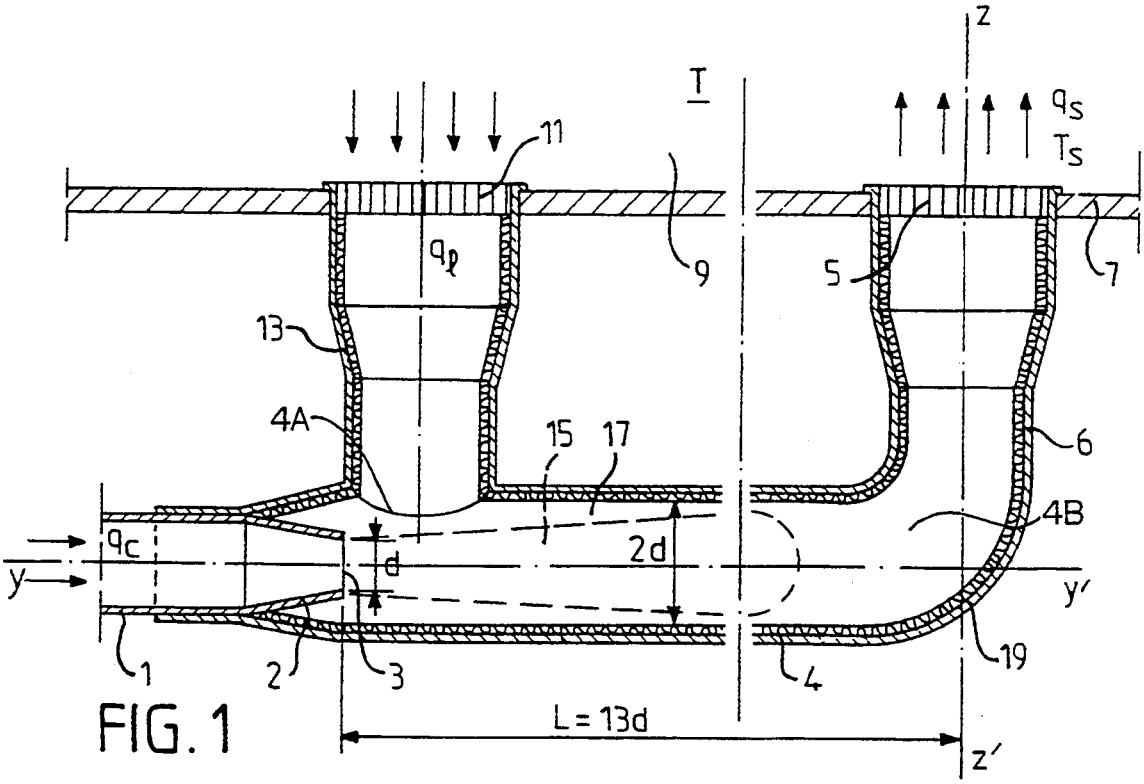
FIG. 1 is a view in horizontal and longitudinal section of a first embodiment of the present invention.

The device shown in FIG. 1 comprises a supply duct (1) of which one end is in communication with an air-conditioning plant (not shown in the drawing), and whose opposite end terminates in a convergent element 2, constituted by a truncated tube of which the section of passage decreases from upstream to downstream in order to form an outlet orifice 3 of diameter d, and which opens out in a coaxial conduit or pipe 4 whose diameter is equal to about twice the diameter d of the outlet orifice 3. This conduit 4 is connected by a duct 6 to a delivery vent 5 disposed in a partition 7 of a room 9 of which it is desired to ensure air-conditioning. An extraction or "take-up" vent 11 is connected to conduit 4 by a transverse "take-up" duct 13 which opens out in the conduit 4 just downstream of the outlet orifice 3 of the convergent element 2. The axis zz' of the delivery vent 5 is distant from the outlet orifice 3 of the convergent element 2 by a length L equal to about 13 times the diameter d of the outlet orifice 3 of the convergent element 2.

Conduit or pipe 4 has an extraction orifice 4A at one end coupled with extraction vent 11 and a delivery orifice 4B at its other end where it joins duct 6 which is connected to the delivery vent 5 at the bend 19 joining the conduit 4 to the delivery vent 5.

Under these conditions, the present device functions as follows:

When an air flow $q_c$ coming from the plant is blown through the convergent element 2, the velocity of the air on leaving the latter is increased and the pressure reduced. In this way, from the outlet orifice 3 of the convergent element 2 there is obtained an axial and central air stream 15 (shown schematically in dashed lines in the Figures) at high velocity and at pressure less than the pressure $P_o$ of the room 9, this velocity decreasing and the pressure increasing progressively towards downstream along this axial stream 15. The depression created by the latter provokes extraction of an air flow from the room 9, through the take-up vent 11 and the duct 13, which flow penetrates into the conduit 4 and forms an annular air stream 17 surrounding the axial air stream 15. The latter takes along the annular air stream 17 which surrounds it, at low velocity, so that, in the present device, the air streams of the outer stream 17, which are in contact with the walls of the conduit 4, move at low velocity and therefore create only an extremely low noise. It will also be noted that the reduction of the noise is further improved by the fact that the annular air stream 17 acts as a sound insulation with respect to all the noises conveyed by the central air stream 15. Of course, the device according to the invention will reach its maximum efficiency only when the length L of the conduit 4 will be such that the central air stream 15, at high velocity, encounters no obstacle and the bend 19 joining the conduit 4 to the delivery vent 5 will therefore, in the present embodiment, have to be located at a sufficient distance from the outlet orifice 3 of the convergent element 2 in order not to be struck by the central air stream 15. In the domain of air-conditioning, such a distance L is at least equal to seven times the diameter d of the outlet orifice 3 of the convergent element 2.

Figure 1A:
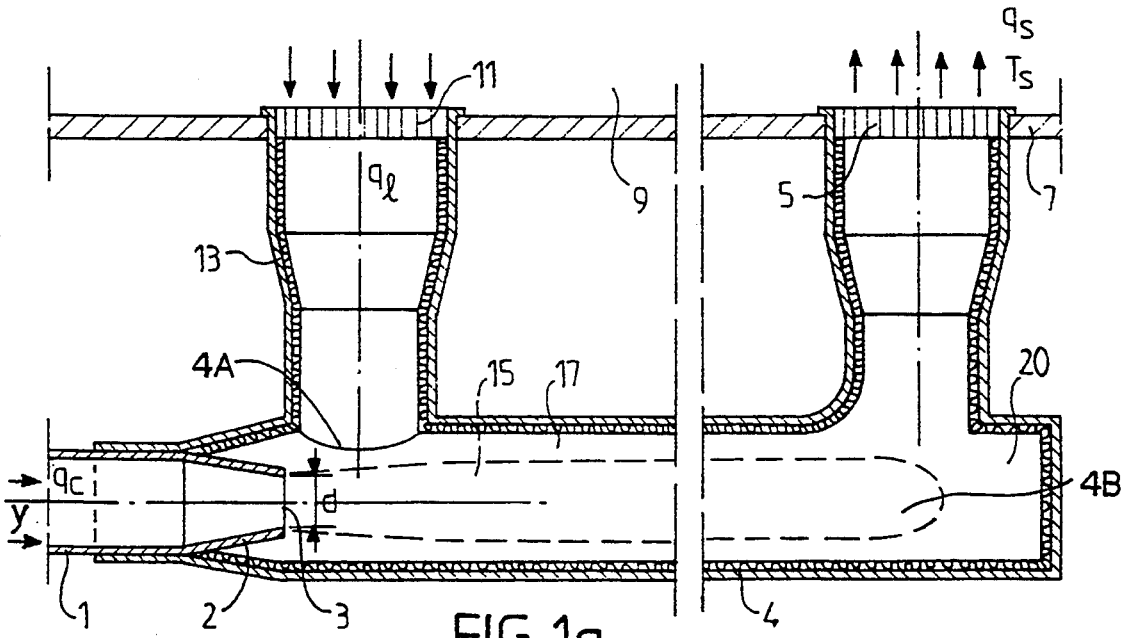
FIG. 1*a* is a view similar to that of FIG. 1, but showing the embodiment of FIG. 1 modified with a pneumatic damping buffer.

However, as shown in FIG. 1*a*, in order to avoid that the central air stream 15 strikes the bend 19 directly, a closed space 20 may be provided whose depth is preferably equal to a quarter of the diameter of the conduit or pipe 4, of which the air that it contains acts as a pneumatic damping buffer. In this figure, the extraction orifice is also designated 4A, and the delivery orifice is designated 4B.

In order to maintain a constant temperature T inside the room 9, the air flow $q_s$ pulsed therein via the delivery vent 5 is at a temperature $T_s$. This air flow $q_s$ is constituted, on the one hand, by a flow $q_l$ taken for example inside the room 9 and which is therefore at temperature T and, on the other hand, by flow $q_c$ at a temperature $T_c$ coming from the plant. The coefficient of induction $\alpha$ which is, by definition, the ratio of the air flow $q_l$ taken for example inside the room 9, on the total flow $q_s$ blown via the delivery vent 5 into the room 9, and which may be varied, on the one hand by construction, and on the other hand by varying the pressure of the air supplied by the plant to the device according to the invention, makes it possible to adapt the latter to the different working conditions desired.

Thus for example, if, taking into account its dimensions and the conditions of outside temperature, the room 9, the device of the prior art necessitates, in order to be maintained at a constant temperature T of 20° C., an air flow at 50° C. of 214 $m^3$/hour, the air at 50° C. thus blown into the room 9 will present a temperature difference of 30° C. with the ambient temperature of 20° C. of said room.

According to the invention, and by choosing a coefficient of induction $\alpha$ of 0.5, i.e. an air flow $q_s$ blown into the room composed of 50% air coming from the plant and 50% air taken from the room 9, there is thus blown into the latter air coming from the mixture of a flow $q_c$ of 214 $m^3$/hr at 50° C. and a flow $q_l$ of 214 $m^3$/hr at 20° C., viz. a flow $q_s$ of 428 $m^3$/hr of air at 35° C. It is thus ascertained that the temperature difference between the air blown into the room 9 and the ambient air thereof is 15° C., viz. half that in the systems of the prior art.

Of course, the coefficient of induction $\alpha$ may be modified as a function of the special cases particular to a given installation. For example, if it is desired further to reduce the temperature difference between the air blown into the room and the ambient air thereof, the coefficient of induction $\alpha$ will be increased. For example, with a coefficient of induction of 0.67, if 67% of the air flow $q_s$ blown into a room is taken for example therefrom, there is thus taken from the latter 428 $m^3$/hr of air at 20° C. which is mixed with 214 $m^3$/hr at 50° C. coming from the plant, so as to blow into the room 9 an air flow $q_s$ of 642 $m^3$/hr of air, at 30° C. The temperature of the air blown into the room 9 therefore now exceeds the ambient temperature only by 13° C.

The present invention also makes it possible to employ an air flow $q_c$ coming from the plant which, at an equal number of calories/negative calories supplied, is less than that of the devices of the prior art.

In this way, instead of blowing in 214 $m^3$/hr of air at 50° C., the plant may supply 134 $m^3$/hr of air at 80° C., which represents the same quantity of calories supplied to the room. By using for example a coefficient of induction $\alpha$ of 0.60, which corresponds to a removal from the room 9 of 60% of the flow $q_s$ blown thereinto, the flow $q_s$ is split up, as seen previously, into, on the one hand, an air flow $q_c$ of 134 $m^3$/hr at 80° C. supplied by the plant and, on the other hand, an air flow $q_l$ of 200 $m^3$/hr at 20° C. taken from the room 9, which corresponds to an overall air flow $q_s$ of 334 $m^3$/hr of air at 44° C.

It is ascertained that it is thus possible, whilst reducing by 6° C. the difference between the temperature of the air blown into the room and the temperature of the latter, also to reduce by 38% the flow $q_c$ supplied by the plant, which makes it possible, on the one hand, to reduce the section of the supply ducts 1 by 38%, and therefore to reduce the dimensions of the installation, to reduce the cost price thereof and, on the other hand, to use plants provided with less powerful ventilators, therefore less expensive to purchase and consuming less electricity.

Figure 4:
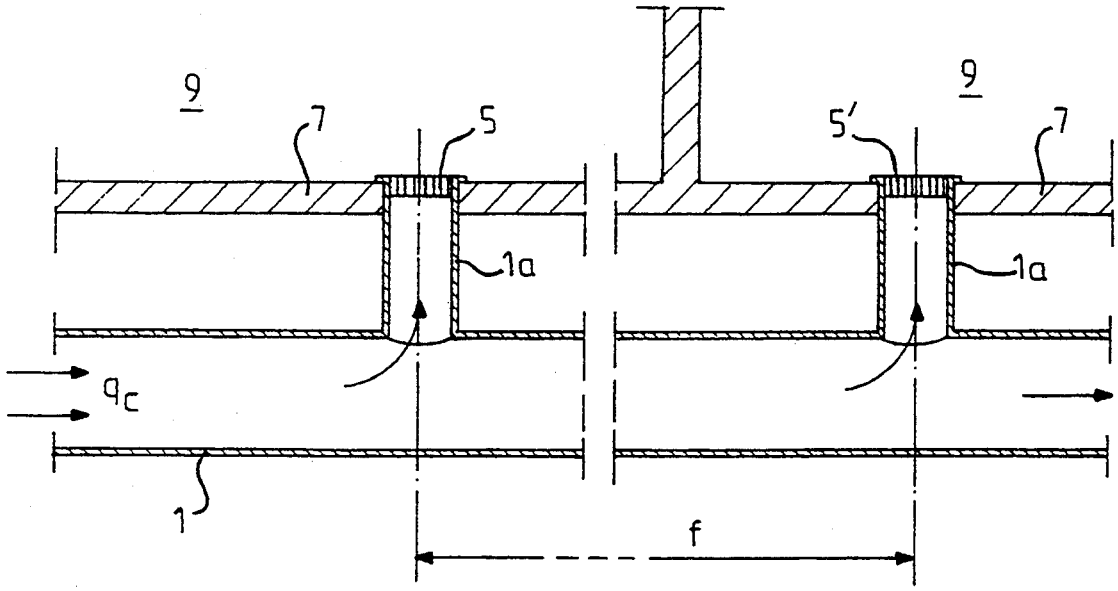
FIG. 4 PRIOR ART
FIG. 4 is a view, in partial horizontal and longitudinal section, of a device according to the prior art.

The present invention is also usable in cooling mode, i.e. in summer, to maintain a room 9 at a constant temperature T, by blowing thereinto air coming from an air-conditioning plant at a temperature T, below the ambient temperature of the room. It is known that, with a device according to the prior art, as shown in FIG. 4, to maintain a room 9 at a temperature T=25° C., with an outside temperature of 32° C., one must blow into the room an airflow of 214 $m^3$/hr at 16° C. Now, the quantity of negative calories thus contributed is not sufficient, and the temperature of the air blown in cannot be reduced without causing a hindrance for the user of the room. One is therefore led to increase the section of the ducts 1 used, in a ratio of 2 to 3, which sometimes renders impossible the passage of these ducts in false ceilings. According to the device of FIG. 1, there may be pulsed in the conduit 4, heat-insulated in order to prevent the phenomena of condensation on the surface thereof, 214 $m^3$/hr of air at 7° C., which supplies a quantity of negative calories double the preceding one, with which is mixed (with a coefficient of induction of 0.6%) 321 $m^3$/hr of air at 25° C. taken from the room 9 so as to blow thereinto 535 $m^3$/hr of air at 17.8° C.

It is thus ascertained that the induction makes it possible not only to supply to the room 9 the quantity of negative calories necessary to ensure control of its temperature, without necessitating an increase in the section of the ducts 1 or of the supply conduits 4, but also to blow therein air closer to the ambient temperature of the room 9, which procures for the user a better comfort. It will be noted that, with an installation according to the prior art, in order to supply the same number of negative calories to the room, under the same conditions of comfort, a flow of 535 $m^3$/hr of air at 17.8° C. should have been pulsed therein.

Figure 2:
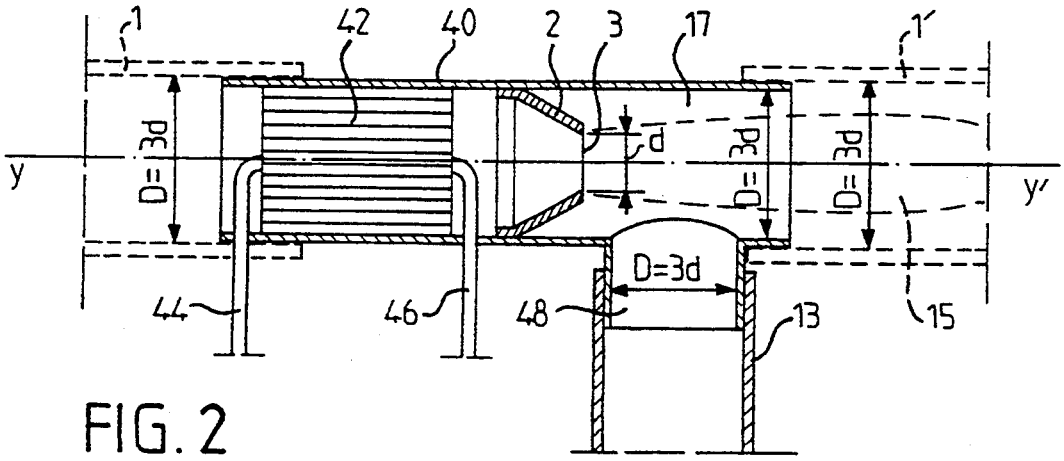
FIGS. 2 and 3 are partial views in horizontal and longitudinal section of two variant embodiments of the device according to the invention.

FIG. 2 shows an assembly composed of a tubular element 40 on one end of which is joined a duct 1 (in dashed lines) with an inner diameter D close to 200 mm, connected to an air-conditioning plant, and of which the other end is connected to another duct 1' (in dashed lines) with the same diameter D, connected to a delivery vent (not shown in the drawing). A cylindrical exchanger 42 is disposed at the inlet of and inside the tubular element 40. The exchanger 42 is supplied with heat-transfer fluid by two pipes 44 and 46. This exchanger 42 is followed by a convergent element 2, of which the outlet orifice 3 presents a diameter d substantially equal to one third of the inner diameter D of the ducts 1, 1'. Immediately downstream of the outlet orifice 3, a transverse cylindrical tube 48, with the same diameter D as the ducts 1, 1', opens out in the tubular element 40. A take-up duct 13, connected to a take-up vent (not shown in the drawing), is connected to the cylindrical tube 40.

This arrangement makes it possible, in the case of the air plant being far from the rooms to be air-conditioned, to limit the thermal losses at the level of the supply ducts, by reducing the difference between the temperature of the air flow transported by these ducts and the ambient air. Each exchanger 42 therefore supplies to the air coming from the plant the calories, or negative calories, which it needs to be at the optimum delivery temperature desired, as a function of the other different parameters of the installation. Moreover, exchangers 42 are usually used combined with means for ensuring a good distribution of the air streams, which makes it possible to improve the homogeneity of the velocity of the air within the air stream supplied to the convergent element 2 and, consequently, that of the central (15) and annular (17) streams and, finally, the qualities of soundproofing of the device according to the invention.

Figure 3:
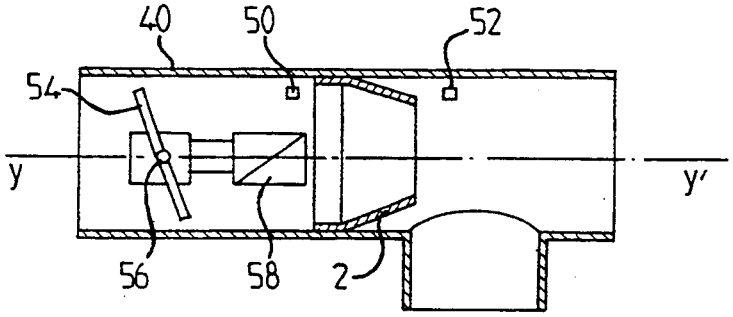

In FIG. 3, the exchanger 42 of FIG. 2 has been replaced by a system for controlling the flow of air pulsed by the plant. This system is composed of two differential sensors 50, 52 disposed respectively upstream and downstream of a convergent element 2 so as to benefit from the loss of pressure created by the latter and which is necessary for this type of measurement. The device comprises a register 54, housed in the tubular element 40, upstream of the convergent element 2, mobile in rotation about a transverse axis 56, and which, as a function of its angular position, makes it possible to obturate more or less the tubular element 40, and servocontrol means 58 adapted to control the register 54 as a function of the measurements of the sensors 50 and 52 and of the operational conditions defined by the user. By using, according to the invention, the pressure drop created by the convergent element 2 to effect measurement, the elements such as cross pieces of the prior art are consequently eliminated.

As shown in FIG. 4, an installation according to the prior art comprises a principal duct 1, of large section, which supplies a series of rooms 9, each comprising a delivery vent 5 connected, by a duct 1*a*, to a principal supply duct 1, ducts 1*a* being mounted in parallel with respect to one another on the principal duct 1. It is known that, in a conventional installation of this type, there is a pressure drop between the delivery vent 5 located most upstream and the delivery vent 5' located most downstream, at a distance which, in the case of a duct of great length, may be considerable. In this way, in the case of the embodiment shown in FIG. 4, and admitting that the distance f separating the upstream (5) and downstream (5') delivery vents is about 50 meters, an average pressure drop of the order of 50 pascals may be taken into account. By adjusting the pressure in the principal duct 1, for the pressure of the downstream vent 5' to have a sufficient pressure, estimated at 20 pascals, the pressure at the level of the upstream delivery vent 5 is consequently 70 pascals. Under these conditions, if the downstream vent 5' is calculated to supply an air flow of 100 $m^3$/hr, the flowrate supplied by the upstream delivery vent is consequently $100\sqrt{70/20}$, viz. 187 $m^3$/hr. The increase in the flowrate of the upstream delivery vent 5 is thus 87% and it is seen, under these conditions, that the means to be employed to return this flowrate to the level of that of the downstream delivery vent 5' will be relatively important since the flowrate must be substantially divided by two.

Figure 5:
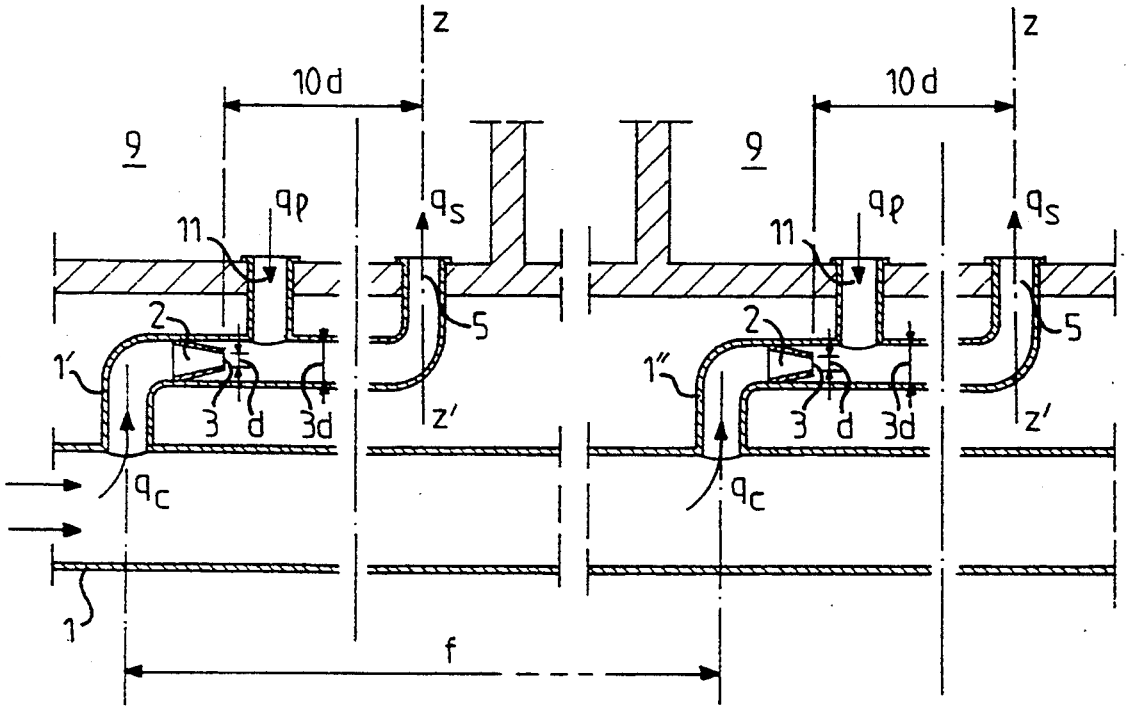
FIG. 5 is a view in horizontal and longitudinal section of a particular form of embodiment of the invention, improving the device shown in FIG. 4.

FIG. 5 represents an installation of the same type, but carried out in accordance with the present invention. It comprises a series of devices such as those shown in FIGS. 1 to 3 previously described, in which the delivery and take-up conduits have diameters of the order of three times that of the outlet orifice 3 of the convergent element 2, and the distances existing between axes zz' of the delivery vents 5 and the outlet orifices 3 of the convergent elements 2 are of the order of 10 times the diameter of these latter. These devices are disposed in parallel on the principal pipe 1 so as to blow into a series of rooms 9 an air flow $q_S$. As previously, it will be admitted that the pressure drop existing between the upstream and downstream supply ducts is 50 pascals. Under these conditions, in order to obtain, at the level of the downstream convergent element 2, a flowrate of about 100 $m^3$/hr, the pressure in the latter must be 300 pascals and this same pressure at the level of the upstream convergent element 2 must consequently be 350 pascals. The flowrate supplied by the latter is consequently $100\sqrt{350/300}$, viz. 110 $m^3$/hr.

It is thus ascertained that the device according to the invention performs a flowrate self-regulating role, since the rate of increase of flowrate due to the same pressure drop which was 87% in an installation according to the prior art, passes to a value of 10% in an installation according to the invention. This difference would be even more marked in the case of a longer supply duct 1 which therefore presents a higher pressure drop. In this way, in the case of a pressure drop between upstream and downstream end vents of 100 pascals, the rates of increase of the flowrate blown by the upstream vent with respect to that of the downstream vent are respectively 144% for the devices according to the prior art and 15% for the devices according to the invention.

Figure 6:
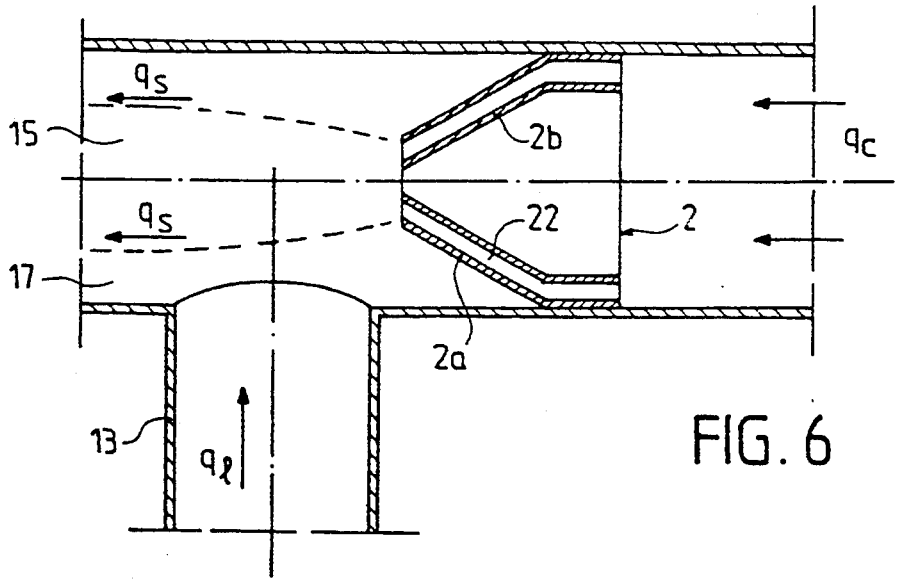
FIGS. 6 and 7 are views in partial horizontal and longitudinal section of two variant embodiments of the device according to the invention.

For considerable air flow rates, a convergent element 2 may, of course, be used, composed of a plurality of coaxial conical frustums. In this way, as shown in FIG. 6, a convergent element 2 may be used, constituted by an outer convergent element **2*a* and an inner convergent element 2*b*, these two elements being connected by longitudinal spacer members 22. This arrangement makes it possible to limit the turbulences and to obtain more stable central (15) and annular (17**) streams, which improves sound-proofing of the device according to the invention.

This arrangement therefore makes it possible, either at equal sound level and equal energy consumed, to increase the coefficient of induction $\alpha$, or with equal coefficient of induction $\alpha$, to reduce the sound level and the energy consumed.

Figure 7:
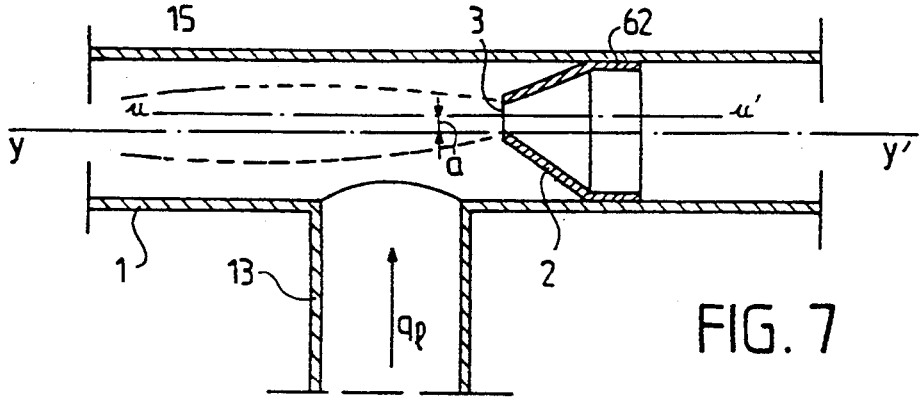

As shown in FIG. 7, the convergent element 2 may be constituted by an off-centered conical frustum, i.e. of which the axis uu' of the outlet orifice 3 is offset laterally by a value a with respect to the longitudinal axis yy' of the supply duct 1. This conical frustum is fast with a cylindrical part 62 of axis yy' fitted inside the duct 1. This arrangement makes it possible, by rotating the assembly of the conical frustum and of the cylindrical part 62 around the axis yy', to vary the coefficient of induction $\alpha$ by moving the central air stream 15 more or less away from the outlet of the take-up duct 13.

Figure 8:
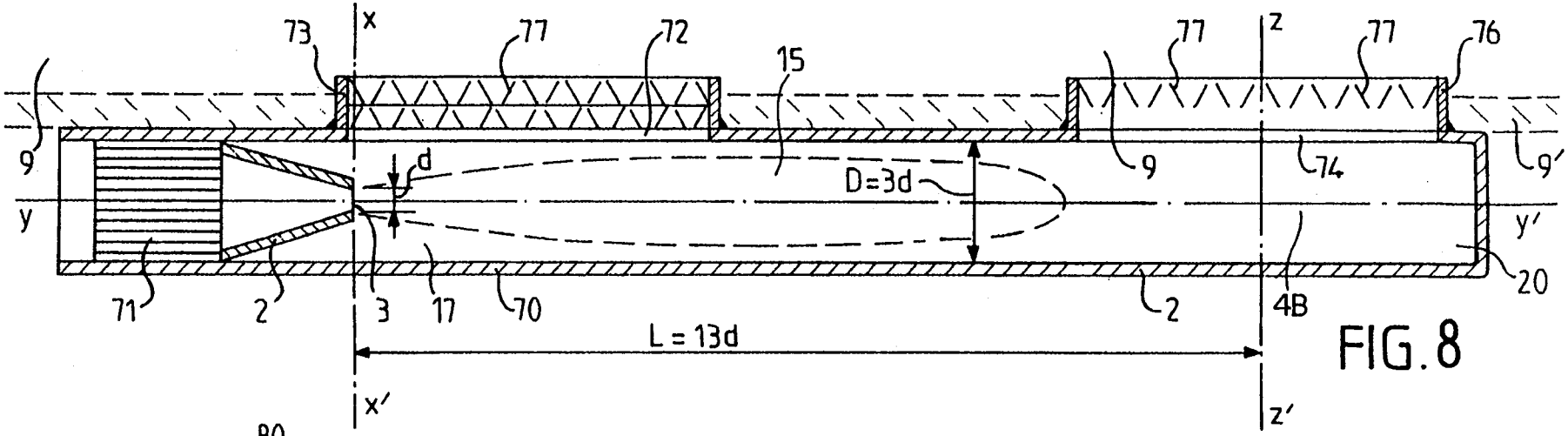
FIG. 8 is a view in horizontal and longitudinal section of a compact assembly of the device according to the invention.

In a particularly interesting variant of the invention, shown in FIG. 8, the device is constituted by an assembly comprising a tubular element 70 of longitudinal axis yy', open at its upstream end and closed at its downstream end. This tubular element 70 receives, from upstream to downstream, a device 71 intended to ensure regulation of the air flow coming from the plant, a convergent element 2, an extraction orifice 4A coupled with a rectangular extraction vent 72, of longitudinal major axis, i.e. parallel to axis yy', made in the wall of the tubular element 70, just downstream of the outlet orifice 3 of the convergent element 2, and a delivery orifice 4B opening out into a delivery vent 74, with the same shape as the extraction vent 72, disposed on the same generatrix of the tubular element 70 as the latter and further downstream. The extraction (72) and delivery (74) vents are surrounded by a frame 73 and 76 respectively, provided with valves 77 intended to ensure a good orientation of the extracted and delivered air flows. According to the invention, the part most upstream of the extraction vent 72 is in alignment, along a transverse axis xx' perpendicular to the longitudinal axis yy', with the outlet orifice 3 of the convergent element 2. Moreover, the axis uu' of the delivery vent 76 is disposed at a distance from the outlet orifice 3 of the convergent element 2 equal to substantially 13 times the diameter d of the outlet orifice 3 of the convergent element 2.

Such an assembly comprises all the elements of the device according to the invention arranged so as to supply a minimum operating noise associated with optimum operational qualities. This assembly is intended to be fixed on the partition 9 of a room to be air-conditioned, without necessitating calculations by the installer due to its unitary design, which largely facilitates execution thereof and also constitutes a guarantee that the different elements of the device have been assembled so as to provide the best result. Device 71, intended to ensure regularization of the air flow coming from the plant, may possibly be provided, in known manner, with exchanger means supplied with heat-transfer fluid via pipes, these exchanger means making it possible to adjust the quantity of calories/negative calories coming from the plant intended to be supplied to the system.

Applicants have ascertained that, by using a convergent element 2 presenting a wall of generally truncated shape, constituted by a series of adjacent corrugations, an improvement in the stability of the flow of the air was obtained which contributed further to reducing the noise of the device.

Figure 10:
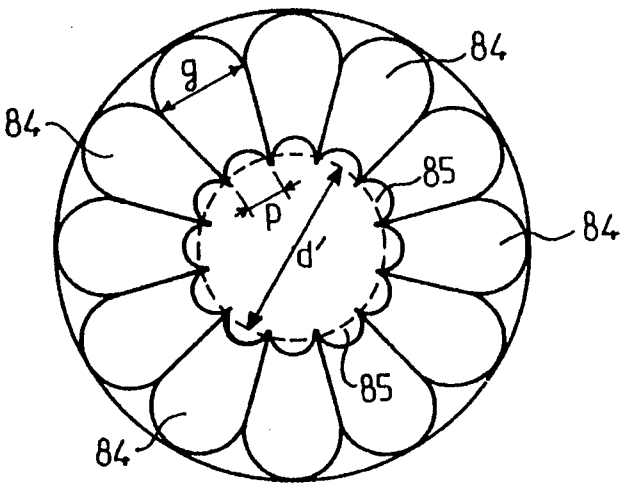
FIG. 10 is a view from the right of the convergent element shown in FIG. 9.
Figure 9:
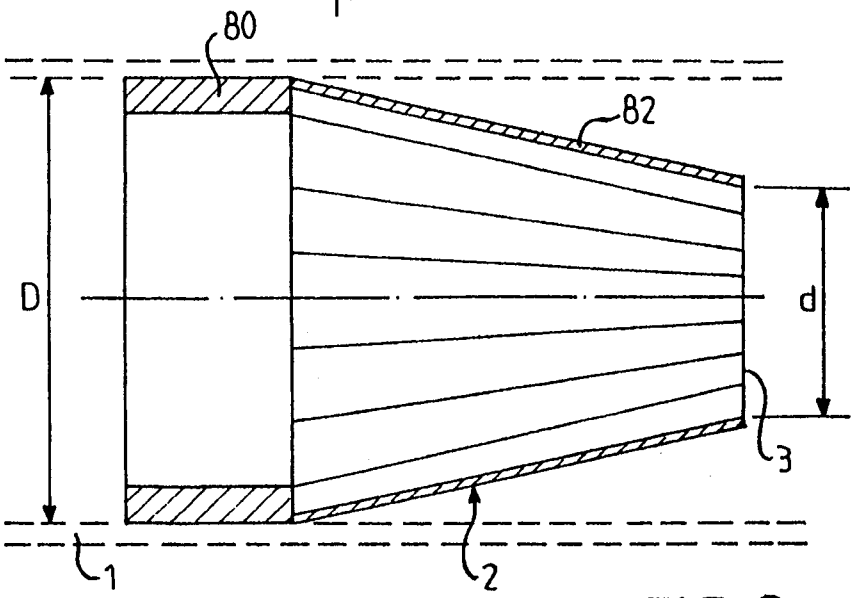
FIG. 9 is a view in longitudinal section of a variant embodiment of a convergent element.

Thus, in the embodiment shown in FIGS. 9 and 10, the convergent element 2 is constituted, from upstream to downstream, by a cylindrical part 80, with an outer diameter preferably equal to the inner diameter D of the air supply duct 1 (shown in broken lines in the drawing), and by a second part 82, overall in the form of a conical frustum, constituted by a series of adjacent corrugations 84, terminating in a downstream outlet orifice 3, of mean diameter d' corresponding to the diameter of the circle defining an internal surface equivalent to the surface of the outlet orifice 3 (shown in broken lines in FIG. 10). The outlet orifice 3 of the convergent element 2 thus presents a periphery constituted by a succession of semi-circles 85. The corrugations 84 are preferably semi-truncated in form. The diameter g of the large base and the diameter p of the small base of these semi truncated cones are equal to one sixth respectively of the diameters D of the cylindrical part 80 and of the mean diameter d of the outlet orifice 3. This arrangement is particularly advantageous in that it enables the contact surface to be increased, which improves stability of the flow.

I claim:

1. A device for regulating the temperature in a room (9) using pulsed low-velocity air flow (qs) to provide a silent flow of air to a room at a low output speed, comprising:

an extraction vent (11, 72) and a delivery vent (5, 74) disposed in the room (9);

a pipe (4, 70) having an extraction orifice (4A) and a delivery orifice (4B), said pipe (4) being in communication with a plant for receiving an air flow (qc) through a pressurized air duct (1) forming a central and axial air flow therein for delivery of air flow (qc) through said delivery orifice (4B) to said delivery vent (5, 74) and for receiving an air flow taken up by said extraction vent (11, 72) for delivery to said pipe (4), said extraction vent (11, 72) opening out into said pipe (4, 70) and said delivery orifice (4B) opening out to said delivery vent (5, 74) from said pipe (4, 70) into the room (9);

means combining the air flow from said extraction vent (11, 72) through said extraction orifice (4A) with the air flow directed to said delivery vent (5, 74) from said pressurized air duct (1) for forming in said pipe (4, 70), between said extraction orifice and said delivery orifice, coaxial air streams including a central air stream (15) in which the air moves at a high velocity towards said delivery vent (5, 74) and a peripheral annular air stream (17) delivered from said extraction orifice and surrounding said central air stream (15) in which the air moves at low velocity between said extraction orifice and said delivery orifice; and said pipe (70) being a tubular element with a circular cross section having an axis (yy') thereby creating an annular and external air stream at very low speed which protects said central air stream at a higher speed, whereby different perturbations of the air stream are avoided.

2. The device according to claim 1, wherein said combining means includes a delivery duct (6), an extraction duct (13), and at least one convergent element (2), and wherein said central air stream (15) and said annular air stream (17) are created by at said least one convergent element (2) delivering an air stream which ultimately becomes said central air stream (15) from upstream to downstream, said one convergent element (2) having an upstream inlet orifice connected to said air supply duct (1) and a downstream outlet orifice (3) opening out into said pipe (4), said extraction vent (11, 72) and said delivery (5, 74) vent being respectively connected to said extraction orifice (4A) and said delivery orifice (4B) by said extraction duct (13) and said delivery (6) duct, the part most upstream of the intersection surface between the extraction duct (13) and said pipe (4, 70) being disposed immediately downstream of said downstream outlet orifice (3) and said annular air stream (17) being created by the air stream introduced through said extraction orifice into said pipe (4, 70) surrounding said central air stream (15).

3. The device according to claim 2, wherein said downstream outlet orifice has a diameter (d) and said convergent element (2) has an axis (uu') and said delivery duct (6) is disposed at a distance (L) from said outlet orifice (3) of said convergent element (2).

4. The device according to claim 2, wherein said duct (1) has an inner diameter (D) and said at least one convergent element comprises a conical frustrum (2) having a large base with an outer diameter identical to the inner diameter (D) of said duct (1).

5. The device according to claim 1, including a convergent element (2) and means (54) upstream of said convergent element (2) for adjusting the rate of the air flow ($q_c$) coming from said pressurized air duct (1) and including on either side of said convergent element (2) pressure sensors (50, 52) for measuring the rate of the air flow delivered by said convergent element, and a heat transfer exchange exchanger (42) upstream of said convergent element (2) for adjusting the temperature of air flow ($q_c$) admitted via air supply conduit (1).

6. The device according to claim 1, wherein said pipe (4) extends from upstream to downstream and has an end closing a closed space (20) extending beyond said delivery orifice (4B), said closed space (20) having a depth (p) equal to about a quarter of the diameter of said pipe (4), so that air contained in said closed space (20) acts as a pneumatic damping buffer.

7. The device according to claim 2, wherein the diameter (D) of said pipe (4) into which said convergent element (2) opens out is equal to at least twice the diameter (d) of said outlet orifice (3) and said delivery duct (6) is disposed at a distance (L) from said outlet orifice (3) which is at least seven times said diameter (d) of said outlet orifice (3).

8. A method for regulating the temperature in a room using a pulsed low-velocity air flow (qs), in which the room is provided with an extraction vent (11, 72) and a delivery vent (5, 74) and a pipe (4, 70) in communication with a pressurized air supply duct (1) and in communication with the extraction vent and the delivery vent via an extraction orifice (4A) and a delivery orifice (4B), the extraction vent (11, 72) opening out into said pipe (4, 70) and the delivery vent (5, 74) opening out from the pipe (4) into the room; and comprising forming in said pipe (4, 70), between the extraction orifice (4A) and delivery orifice (4B), a first annular stream (15) derived from an air flow delivered through said pressurized air supply duct (1) and a second annular air stream (17) surrounding said first air stream (15) for causing thereof to form a central air stream derived from an exhaust of air from the room through said extraction vent (11, 72) supplied therefrom through the extraction orifice (4A) to form coaxial air streams which includes the central stream formed from said first air stream (15) derived from said pressurized air supply duct (1) and forming the first air stream and an inner air stream of the coaxial air streams in which the air moves at a high velocity upon introduction of said pressurized air supply duct (1) and a peripheral annular air stream forming an outer air stream of the coaxial air streams and derived from said second air stream (17) introduced into said pipe (4, 70) from said extraction orifice (4A) in which the air moves at a low velocity and surrounding said central air stream in which the air moves at the high velocity.

9. The method according to claim 8, including:

forming said second annular air stream (17) by the displacement of the first annular stream (15) as supplied from said air supply duct (1) to form the central air stream by displacing the first stream from its position adjacent to the inner peripheral surface of said pipe (4, 70) with the air extracted from the room (9) when the second air stream (17) enters into said pipe (4, 70) through said extraction orifice (4A) supplied thereto through said extraction vent (11, 72) and then fed into said pipe (4, 70).

10. The method according to claim 9, including creating the central air stream from said first annular air stream (15) by placing at least one convergent element (2) in said pipe (4, 70) from upstream to downstream, via the air supply duct (1) by supplying the air flow (qc) through said convergent element (2) which is connected to a pressurized air supply, said convergent element (2) having a downstream outlet orifice (3) opening out into the pipe (4, 70), and then surrounding the first annular air stream (15) with the second annular air stream (17) to form a peripheral air stream delivered to said pipe (4, 70) through the extraction vent (11, 72), the extraction orifice (4A) being coupled with the pipe (4, 70) by an extraction duct (13).

11. The method according to claim 8, including forming said peripheral annular air stream from said second annular air stream (17) by displacing said central air stream formed from said first annular air stream (15) with air extracted from the room (9) by said extraction vent (11, 72) and supplied to said pipe (4) through said extraction orifice (4A).

12. A device for regulating the temperature in a room using pulsed low-velocity air flow (qs), comprising:

an extraction vent (11, 72) and a delivery vent (5, 74) disposed in the room (9);

a convergent element (2) in communication with an air flow (qc) coming from a plant;

a pipe (4) in communication with said convergent element (2) and said air flow (qc) through a pressurized air supply duct (1), said pipe (4) having an extraction orifice (4A) and a delivery orifice (4A), said extraction vent (11, 72) opening into said pipe (4) through said extraction orifice (4A) and said delivery vent (5, 74) opening out from said pipe (4) through said delivery orifice (4B);

means for forming in said pipe (4), between said extraction orifice and said delivery orifice, coaxial air streams including a central air stream (15) in which the air moves at a high velocity and a peripheral annular air stream (17) surrounding said central air stream in which the air moves at low velocity; and said convergent element (2) comprising, from upstream to downstream, a first cylindrical part (80) having an outer diameter (D) equal to the inner diameter of said air supply duct (1) and a second part having an overall conical frustrum form (82) formed by a series of corrugations (84).

13. The device according to claim 12, wherein said convergent element has an outlet orifice (3) having a mean diameter (d'), said corrugations (84) being of a substantially truncated form, and having a large and a small base, said small base having a diameter equal to about a sixth of the respective diameters (D) of said first cylindrical part (80) and of said mean diameter (d') of said outlet orifice (3) of said convergent element (2).

14. The device of claim 12, wherein said convergent element (2) is upstream of said extraction orifice.

15. The device according to claim 12, comprising means for adjusting the rate of air flow admitted by said air supply conduit (1).

16. A device for regulating the temperature in a room (9) using pulsed low-velocity air flow (qs) to provide a silent flow of air to a room at a low output speed, comprising:

an extraction vent (11, 72) and a delivery vent (5, 74) disposed in the room (9);

a pipe (4, 70) having an extraction orifice (4A) and a delivery orifice (4B), said pipe (4) being in communication with a plant for receiving an air flow (qc) through pressurized air duct (1) forming a central and axial air flow therein for delivery of air flow (qc) through said delivery orifice (4B) to said delivery vent (5, 74) and for receiving an air flow taken up by said extraction vent (11, 72) for delivery to said pipe (4), said extraction vent (11, 72) opening out into said pipe (4, 70) and said delivery orifice (4B) opening out to said delivery vent (5, 74) from said pipe (4, 70) into the room (9);

means combining the air flow from said extraction vent (11, 72) through said extraction orifice (4A) with the air flow directed to said delivery vent (5, 74) from said pressurized air duct (1) for forming in said pipe (4, 70), between said extraction orifice (4A) and said delivery orifice (4B), coaxial air streams including a central stream (15) in which the air moves at a high velocity towards said delivery vent (5, 74) and a peripheral annular air stream (17) delivered from said extraction orifice and surrounding said central air stream (15) in which the air moves at low velocity between said extraction orifice (4A) and said delivery orifice (4B); and said pipe 70 being a tubular element with a circular cross section having an axis (yy').

17. A device for regulating the temperature in a room (9) using pulsed low-velocity air flow (qs) to provide a silent flow of air to a room at a low output speed, comprising:

an extraction vent (11, 72) and a delivery vent (5, 74) disposed in the room (9);

a pipe (4, 70) having an extraction orifice (4A) and a delivery orifice (4B), said pipe (4) being in communication with a plant for receiving an air flow (qc) through pressurized air duct (1) forming a central and axial air flow therein for delivery of air flow (qc) through said delivery orifice (4B) to said delivery vent (5, 74) and for receiving an air flow taken up by said extraction vent (11, 72) for delivery to said pipe (4), said extraction vent (11, 72) opening out into said pipe (4, 70) and said delivery orifice (4B) opening out to said delivery vent (5, 74) from said pipe (4, 70) into the room (9); and means combining the air flow from said extraction vent (11, 72) through said extraction orifice (4A) with the air flow directed to said delivery vent (5, 74) from said pressurized air duct (1) for forming in said pipe (4, 70), between said extraction orifice (4A) and said delivery orifice (4B), coaxial air streams including a central stream (15) in which the air moves at a high velocity towards said delivery vent (5, 74) and a peripheral annular air stream (17) delivered from said extraction orifice (4A) and surrounding said central air stream (15) in which the air moves at low velocity between said extraction orifice (4A) and said delivery orifice (4B);

said combining means including a delivery duct (6), and extraction duct (13), and at least one convergent element (2), and wherein said central air stream (15) and said annular air stream (17) are created by at said least one convergent element (2) delivering an air stream which ultimately becomes said central air stream (15) from upstream to downstream, said one convergent element (2) having an upstream inlet orifice connected to said air supply duct (1) and a downstream outlet orifice (3) opening out into said pipe (4), said extraction vent (11, 72) and said delivery (5, 74) vent being respectively connected to said extraction and delivery orifices by said extraction duct (13) and said delivery (6) duct, the part most upstream of the intersection surface between the extraction duct (13) and said pipe (4, 70) being disposed immediately downstream of said downstream outlet orifice (3) and said annular air stream (17) being created by the air stream introduced through said extraction orifice into said pipe (4, 70) surrounding said central air stream (15);

said pipe (70) being a tubular element with a circular cross-section having an axis (yy') and said downstream outlet orifice has a diameter (d) and said convergent element (2) has an axis (uu') and said delivery duct (6) is disposed at a distance (L) from said outlet orifice (3) of said convergent element (2); and the diameter (D) of said pipe (4) into which said convergent element (2) opens out is equal to at least twice the diameter (d) of said outlet orifice (3) and said delivery duct (6) is disposed at a distance (L) from said outlet orifice (3) which varies between at least seven and thirteen times said diameter (d) of said outlet orifice (3).

18. A device for regulating the temperature in a room (9) using pulsed low-velocity air flow (qs) to provide a silent flow of air to a room at a low output speed, comprising:

an extraction vent (11, 72) and a delivery vent (5, 74) disposed in the room (9);

a pipe (4, 70) having an extraction orifice (4A) and a delivery orifice (4B), said pipe (4) being in communication with a plant for receiving an air flow (qc) through pressurized air duct (1) forming a central and axial air flow therein for delivery of air flow (qc) through said delivery orifice (4B) to said delivery vent (5, 74) and for receiving an air flow taken up by said extraction vent (11, 72) for delivery to said pipe (4), said extraction vent (11, 72) opening out into said pipe (4, 70) and said delivery orifice (4B) opening out to said delivery vent (5, 74) from said pipe (4, 70) into the room (9); and means combining the air flow from said extraction vent (11, 72) through said extraction orifice (4A) with the air flow directed to said delivery vent (5, 74) from said pressurized air duct (1) for forming in said pipe (4, 70), between said extraction orifice (4A) and said delivery orifice (4B), two coaxial air streams including a central stream (15) in which the air moves at a high velocity towards said delivery vent (5, 74) and a peripheral annular air stream (17) delivered from said extraction orifice (4A) and surrounding said central air stream (15) in which the air moves at low velocity between said extraction orifice and said delivery orifice;

said combining means including a delivery duct (6), an extraction duct (13), and at least one convergent element (2), and wherein said central air stream (15) and said annular air stream (17) are created by at said least one convergent element (2) delivering an air stream which ultimately becomes said central air stream (15) from upstream to downstream, said one convergent element (2) having an upstream inlet orifice connected to said air supply duct (1) and a downstream outlet orifice (3) opening out into said pipe (4), said extraction vent (11, 72) and said delivery vent (5, 74) being respectively connected to said extraction and delivery orifices by said extraction duct (13) and said delivery (6) duct, the part most upstream of the intersection surface between the extraction duct (13) and said pipe (4, 70) being disposed immediately downstream of said downstream outlet orifice (3) and said annular air stream (17) being created by the air stream introduced through said extraction orifice into said pipe (4, 70) surrounding said central air stream (15); and said convergent element (2) comprising a first outer conical frustrum (2*a*) and a second inner conical frustrum (2*b*) coaxial with said first outer conical frustrum (2*a*) and fixed with said first conical frustrum (2*a*) by radial and longitudinal spacers (22).

19. A device for regulating the temperature in a room (9) using pulsed low-velocity air flow (qs) to provide a silent flow of air to a room at a low output speed, comprising:

an extraction vent (11, 72) and a delivery vent (5, 74) disposed in the room (9);

a pipe (4, 70) having an extraction orifice (4A) and a delivery orifice (4B), said pipe (4) being in communication with a plant for receiving an air flow (qc) through pressurized air duct (1) forming a central and axial air flow therein for delivery of air flow (qc) through said delivery orifice (4B) to said delivery vent (5, 74) and for receiving an air flow taken up by said extraction vent (11, 72) for delivery to said pipe (4), said extraction vent (11, 72) opening out into said pipe (4, 70) and said delivery orifice (4B) opening out to said delivery vent (5, 74) from said pipe (4, 70) into the room (9); and means combining the air flow from said extraction vent (11, 72) through said extraction orifice (4A) with the air flow directed to said delivery vent (5, 74) from said pressurized air duct (1) for forming in said pipe (4, 70), between said extraction orifice (4A) and said delivery orifice (4B), two coaxial air streams including a central stream (15) in which the air moves at a high velocity towards said delivery vent (5, 74) and a peripheral annular air stream (17) delivered from said extraction orifice (4A) and surrounding said central air stream (15) in which the air moves at low velocity between said extraction orifice and said delivery orifice;

said combining means including a delivery duct (6), an extraction duct (13), and at least one convergent element (2), and wherein said central air stream (15) and said annular air stream (17) are created by at said least one convergent element (2) delivering an air stream which ultimately becomes said central air stream (15) from upstream to downstream, said one convergent element (2) having an upstream inlet orifice connected to said air supply duct (1) and a downstream outlet orifice (3) opening out into said pipe (4), said extraction vent (11, 72) and said delivery vent (5, 74) being respectively connected to said extraction and delivery orifices by said extraction duct (13) and said delivery (6) duct, the part most upstream of the intersection surface between the extraction duct (13) and said pipe (4, 70) being disposed immediately downstream of said downstream outlet orifice (3) and said annular air stream (17) being created by the air stream introduced through said extraction orifice into said pipe (4, 70) surrounding said central air stream (15);

said duct (1) having an inner diameter (d) and said at least one convergent element comprising a conical frustrum (2), said conical frustrum (2) having a large base with an outer diameter identical to the inner diameter (D) of said duct (1); and said longitudinal axis (uu') of said outlet orifice (3) of said convergent element (2) being offset transversely with respect to the longitudinal axis (yy') of said supply duct (1).

20. A device for regulating the temperature in a room (9) using pulsed low-velocity air flow (qs) to provide a silent flow of air to a room at a low output speed, comprising:

an extraction vent (11, 72) and a delivery vent (5, 74) disposed in the room (9);

a pipe (4, 70) having an extraction orifice (4A) and a delivery orifice (4B), said pipe (4) being in communication with a plant for receiving an air flow (qc) through pressurized air duct (1) forming a central and axial air flow therein for delivery of air flow (qc) through said delivery orifice (4B) to said delivery vent (5, 74) and for receiving an air flow taken up by said extraction vent (11, 72) for delivery to said pipe (4), said extraction vent (11, 72) opening out into said pipe (4, 70) and said delivery orifice (4B) opening out to said delivery vent (5, 74) from said pipe (4, 70) into the room (9);

means combining the air flow from said extraction vent (11, 72) through said extraction orifice (4A) with the air flow directed to said delivery vent (5, 74) from said pressurized air duct (1) for forming in said pipe (4, 70), between said extraction orifice and said delivery orifice (4B), two coaxial air streams including a central stream (15) in which the air moves at a high velocity towards said delivery vent (5, 74) and a peripheral annular air stream (17) delivered from said extraction orifice (4A) and surrounding said central air stream (15) in which the air moves at low velocity between said extraction orifice (4A) and said delivery orifice (4B); and a convergent element (2) comprising, from upstream to downstream, a first cylindrical part (80) having an outer diameter (D) equal to the inner diameter of said air supply duct (1) and a second part having an overall conical frustrum form (82) formed by a series of corrugations (84).

21. The device according to claim 20, wherein said corrugations (84) are of substantially semi-truncated form, said corrugations having a large base with a diameter (g) and a small base with a diameter (p), the respective diameters (g) and (p) of said large base and of said small base being of the semi-truncated corrugations (84) and being equal to about a sixth of the respective diameters (D) of said first cylindrical part (80) and said outlet orifice (3) of said convergent element (2) having a mean diameter (d').

* * * * *